US005355633A

United States Patent [19]

Ishikawa et al.

[11] Patent Number: 5,355,633

[45] Date of Patent: Oct. 18, 1994

[54] METHOD OF GRINDING A WORKPIECE HAVING PLURAL CYLINDRICAL PORTIONS WITH PLURAL GRINDING WHEELS

[75] Inventors: Toshio Ishikawa, Anjo; Masahiko Yokoi, Obu; Shozo Kobayashi, Toyota; Hisashi Kubota, Aichi; Yoshiki Kawachi, Toyota, all of Japan

[73] Assignee: Toyoda Koki Kabushiki Kaisha, Kariya, Japan

[21] Appl. No.: 996,041

[22] Filed: Dec. 23, 1992

[30] Foreign Application Priority Data

Dec. 26, 1991 [JP] Japan ..... 3-345429

[51] Int. Cl.[5] ..... B24B 49/00

[52] U.S. Cl. ..... 451/5; 451/10; 451/62; 451/407

[58] Field of Search ..... 51/165 R, 165.71, 165.74, 51/165.75, 165.76, 165.77, 281 R, 281 C, 326, 238 R, 238 S, 238 GG

[56] References Cited

U.S. PATENT DOCUMENTS 2,693,062 11/1954 Silven et al. ..... 51/238 S
2,844,921 7/1958 Hill .
3,690,070 9/1972 Ohta ..... 51/105
3,731,566 5/1973 Kurimoto et al. ..... 51/238 S
3,904,390 9/1975 Bottomley ..... 51/165.8

FOREIGN PATENT DOCUMENTS 55-120976 9/1980 Japan .
57-177627 5/1982 Japan .
57-149151 9/1982 Japan .
1084842 9/1967 United Kingdom .

*Primary Examiner*—M. Rachuba
*Attorney, Agent, or Firm*—Oblon, Spivak, McClelland, Maier & Neustadt

[57] ABSTRACT

A method of grinding plural journal portions of a workpiece with plural grinding wheels. In the method, a pair of work rests are used to support two selected journal portions, and the selected two journal portions have a larger initial diameter as compared with the rest of the journal portions. Initially, the selected journal portions are ground without using the work rests. When the diameter of the selected journal portions becomes substantially equal to the diameters of the rest of the journal portions, the work rests are advanced to support the selected journal portions. After that, the grinding wheels are again advanced to grind all the journal portions.

4 Claims, 5 Drawing Sheets

METHOD OF GRINDING A WORKPIECE HAVING PLURAL CYLINDRICAL PORTIONS WITH PLURAL GRINDING WHEELS

BACKGROUND OF THE INVENTION

1. Field of the Invention

This invention relates to a method of grinding a workpiece having plural cylindrical portions to be ground, and more specifically, relates to a method of grinding a workpiece having plural cylindrical portions with plural grinding wheels, wherein the plural cylindrical portions of the workpiece are ground using a work rest for supporting one or more cylindrical portions.

2. Prior Art of the Invention

In general, a grinding machine having plural grinding wheels 1A–1F is used to simultaneously grind plural journal portions 2A–2F of a workpiece 2, as shown in FIG. 1. In such grinding machine, the workpiece 2 is deformed, as shown in FIG. 1, when all of the grinding wheels 1A–1F contact the journal portions 2A–2F of the workpiece 2, because of the large grinding force acting upon the workpiece 2. Therefore, in such grinding machine, work rests 3 are installed to support one or more journal portions, for example, the two journal portions, 2B and 2E.

However, in such grinding machine, the grinding accuracy is deteriorated when the journal portions 2B and 2E to be supported by the work rests 3 have been machined inaccurately in previous machining such as the cutting operation using a lathe. Namely, if the journal portions 2B and 2E have distorted outer surfaces, the positions of the center of the journal portions 2B and 2E irregularly changes, because of the contact between the distorted outer surfaces of the journal portions 2B and 2E and the work rests 3 during rotation.

SUMMARY OF THE INVENTION

Accordingly, it is an objective of the present invention to provide an improved method of grinding a workpiece having plural cylindrical portions to be simultaneously ground with plural grinding wheels, wherein the cylindrical portions are accurately ground without being affected by the initial accuracy of the cylindrical portions.

Briefly, the present invention provides a method of grinding plural cylindrical portions of a workpiece with plural grinding wheels. In this method, a workpiece having plural cylindrical portions previously machined with some cylindrical portions having a larger diameter compared to the rest of the cylindrical portions can be accurately ground despite the previous inaccurate machining of the cylindrical portions. A work rest having a contact shoe engagable with selected cylindrical portion is also used in this method. Initially, the contact shoe is positioned at a position away from the selected cylindrical portion. Then the grinding wheels is advanced in a first grinding step to partially grind the selected cylindrical portion without using the work rest. The contact shoe is then advanced to support the selected cylindrical portion, which already has been partially ground, and the grinding wheels are further advanced in a second grinding step to grind all of the cylindrical portions to a predetermined dimension.

Since the cylindrical portion having a larger diameter is initially ground without engaging the work rest, the selected cylindrical portion can be ground very accurately regardless of the initial accuracy of the selected cylindrical portion. Further, all the cylindrical portions are accurately ground, because the selected cylindrical portion supported by the work rest has been ground to have an accurate outer surface. Therefore, all of the cylindrical portions can be accurately ground regardless of the initial accuracy of the cylindrical portions.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiment when considered in connection with the accompanying drawings, in which.

DETAILED DESCRIPTION OF PREFERRED EMBODIMENTS

Figure 1:
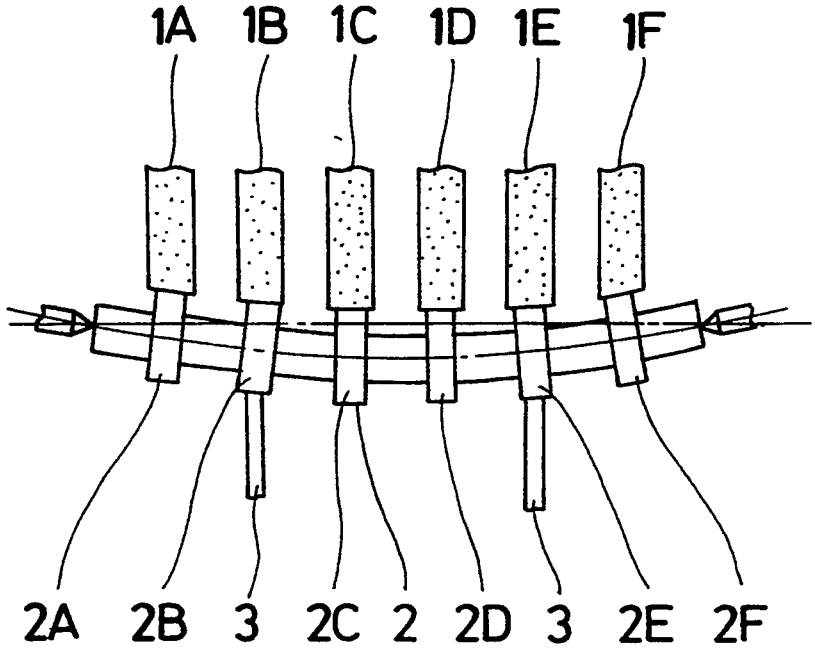
FIG. 1 (PRIOR ART)
FIG. 1 is an explanatory diagram illustrating a conventional grinding method.
Figure 2:
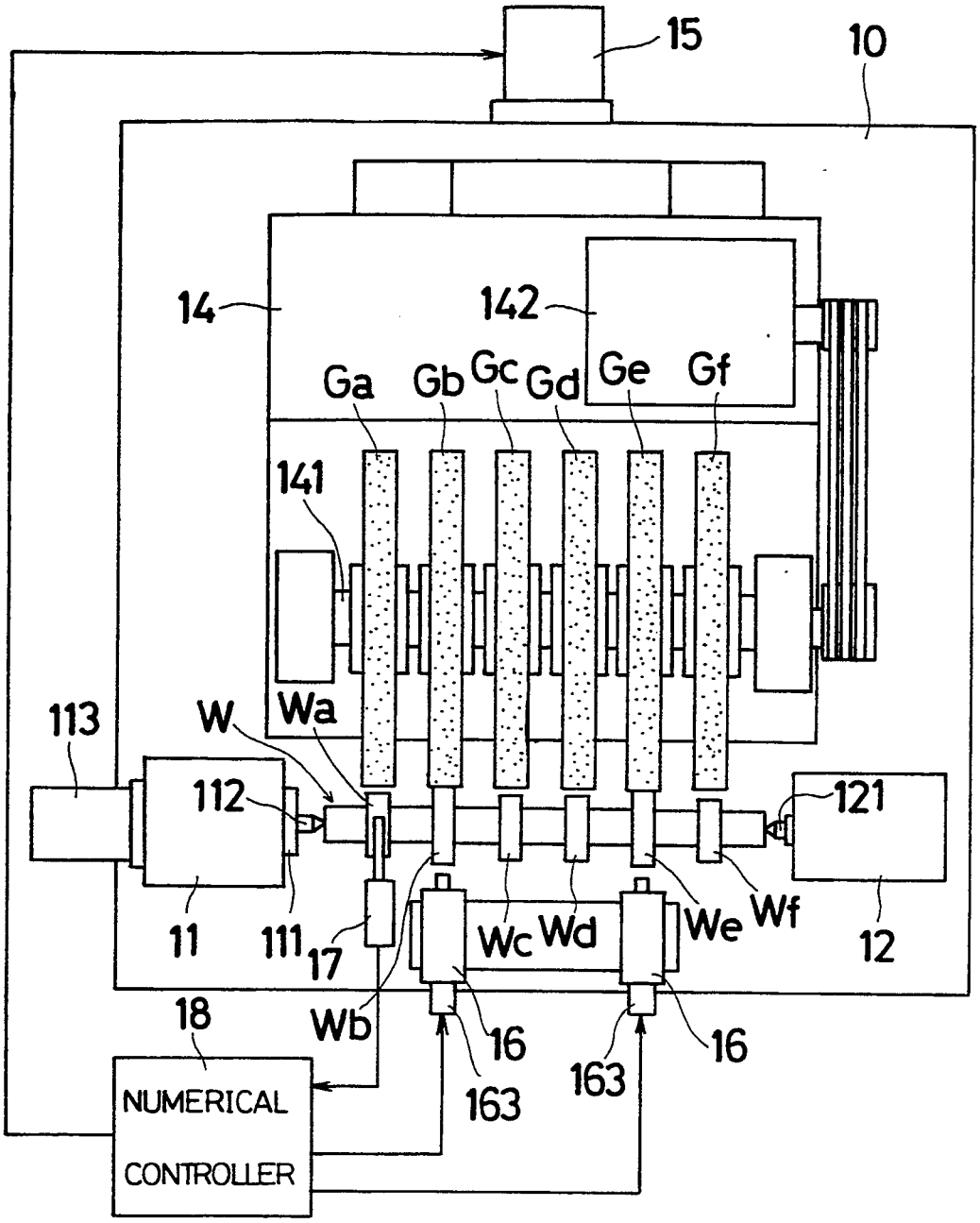
FIG. 2 is a plan view of a grinding machine which is used for carrying out a grinding method according to the present invention.

A preferred embodiment of the present invention will be now described with reference to drawings. In FIG. 2, numeral 10 indicates a bed of a grinding machine on which a spindle head 11 and a tail stock 12 are mounted. The spindle head 11 is provided with a main spindle 111 having a center 112, and the main spindle 111 is rotated by a motor 113. The tail stock 12 is also provided with a center 121. Supported between the centers 112 and 121 is a workpiece W having plural cylindrical journal portions Wa–Wf which are separately formed in the axial direction of the workpiece W.

A wheel head 14 is mounted on the bed 10 for movement in a direction perpendicular to the rotational axis of the main spindle 111. The wheel head 14 is moved by a servomotor 15 through a not-shown feed mechanism, and supports plural grinding wheels Ga–Gf through a wheel spindle 141. The wheel spindle 141 is rotated by a motor 142 through pulleys and belts.

Figure 3:
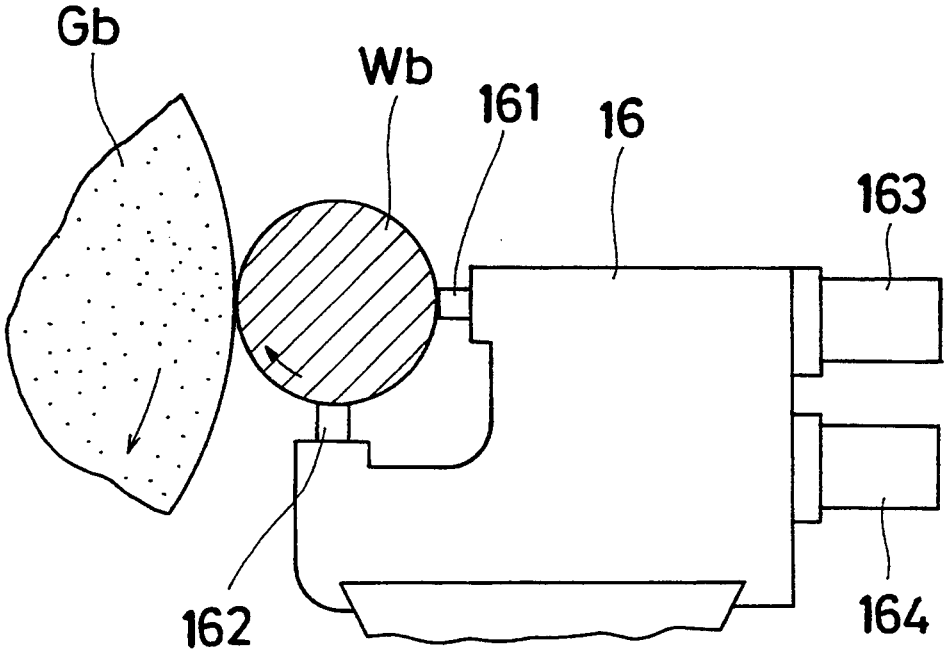
FIG. 3 is a side view of the work rest shown in FIG. 2.

A pair of work rests 16 are also mounted on the bed 10 at locations corresponding to two selected journal portions Wb and We. Each of the work rests 16 is provided with a side contact shoe 161, which is engagable with each side portion of the journal portions Wb and We, and a lower contact shoe 162, which is engagable with each lower portion of the journal portions Wb and We, as shown in FIG. 3. The side contact shoe 161 and lower contact shoe 162 are moved back and forth, with respect to the rotational axis of the main spindle 111, by servomotors 163 and 164, respectively.

Further, the grinding machine is provided with a measuring device 17 for measuring the diameter of a selected journal portion, for example, journal portion Wa, and outputs signals when the diameter of the journal portion Wa reaches plural reference diameters at which the feed rate of the wheel head 14 will be changed. The output signals from the measuring device 17 are lead to a numerical controller 18. The numerical controller 18 is provided with a memory (not shown) in which numerical control data is stored. The servomotors 15, 163 and 164 are driven in accordance with the numerical control data and the signals from the measuring device 17.

Figure 5:
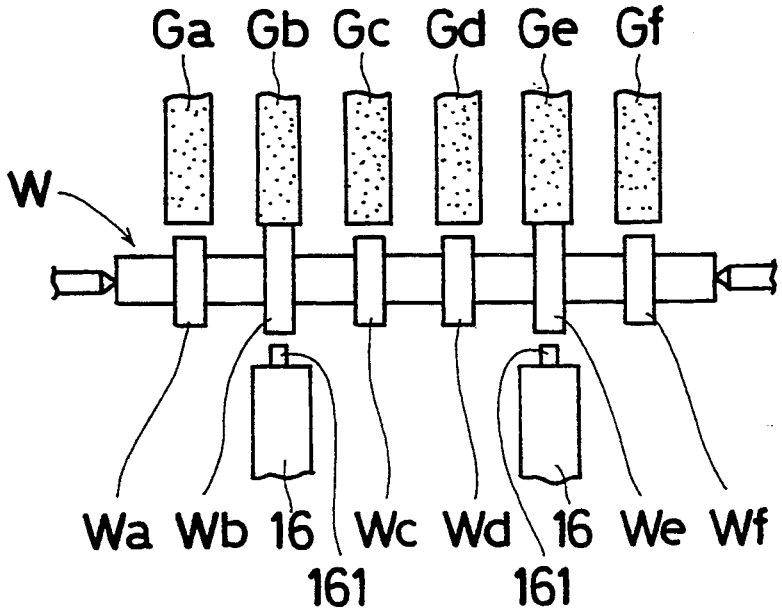
FIG. 5 is an explanation diagram illustrating a first grinding step for grinding selected journal portions having a larger diameter without engaging the work rests.
Figure 6:
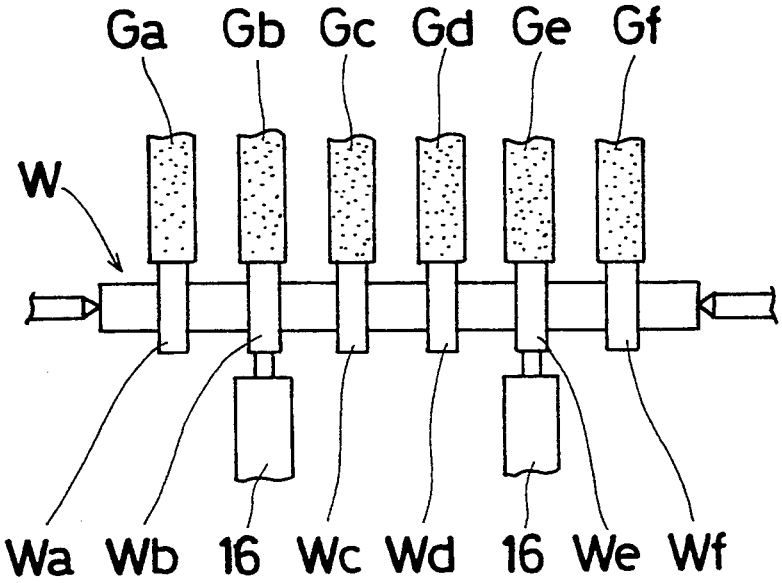
FIG. 6 is an explanatory diagram illustrating a second grinding step for grinding all of the journal portions while utilizing the work rests.

The grinding method according to the present invention will be now described with reference to FIGS. 4, 5 and 6.

For illustration, in a previous machining operation, such as a lathe cutting operation, the workpiece W has been machined, resulting in the journal portions Wb and We having a larger diameter than the other journal portions Wa, Wc, Wd and Wf, as shown in FIG. 2. It is preferred that a size difference between the selected journal portions Wb and We, and other journal portions Wa, Wc, Wd and Wf be adjusted to be larger than the sum of the amount of distortion of the outer surfaces of the journal portions after cutting operation and the amount of deflection of the rotational centers of the journal portions from the rotational axis of the workpiece W.

After the workpiece W is loaded onto the grinding machine and supported between the spindle head 11 and the tail stock 12, the motor 113 is activated to rotate the main spindle 111. Since the rotation of the main spindle 111 is transmitted to the workpiece W through a rotational torque transmission mechanism (not shown), the workpiece W is rotated at a predetermined speed.

Figure 4:
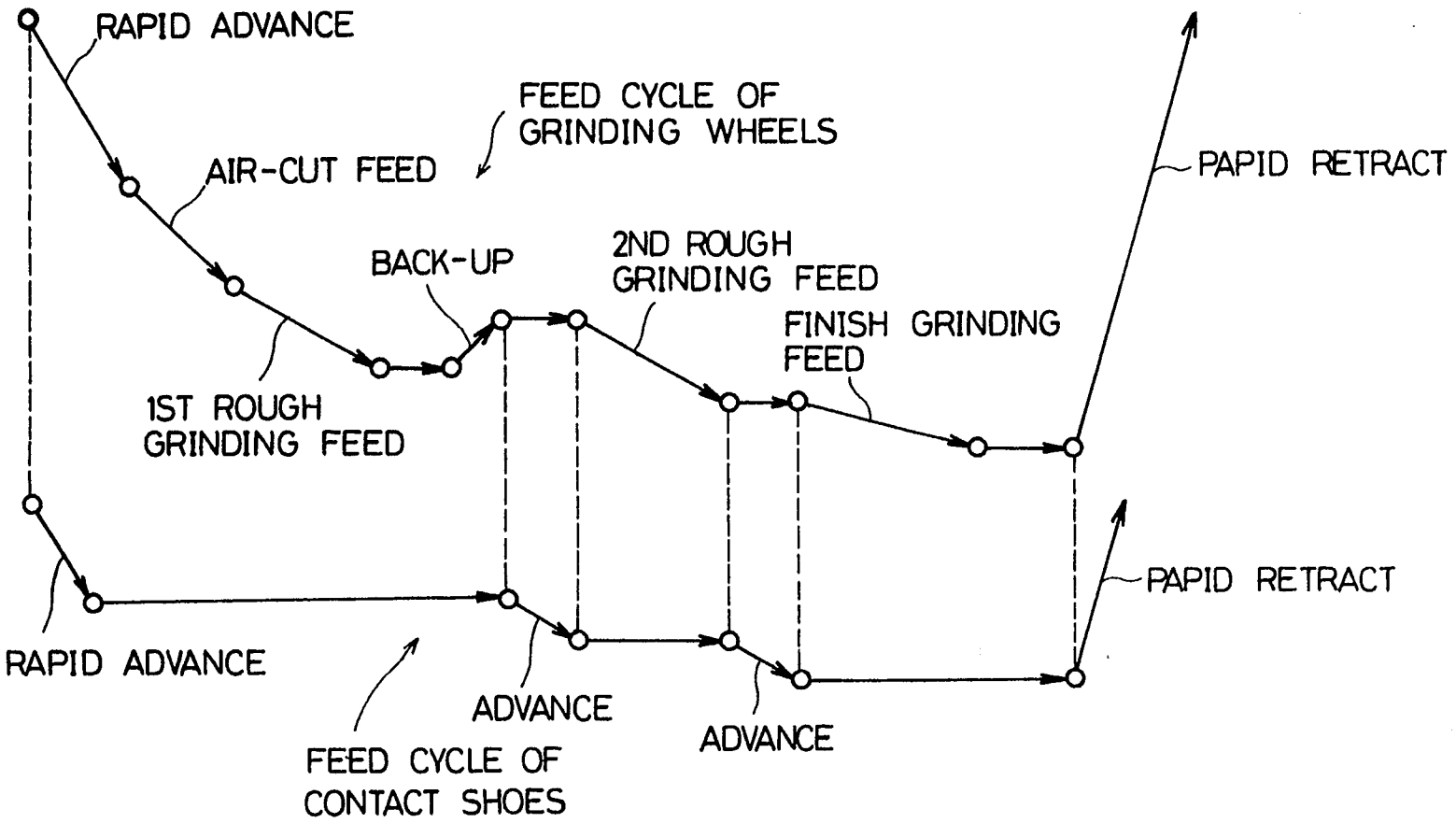
FIG. 4 is an explanation chart showing a grinding cycle according to the present embodiment.

After that, a grinding cycle shown in FIG. 4 is started. The wheel head 14 is first advanced at a rapid feed rate. At the same time, the side contact shoes 161 and lower contact shoes 162 of the work rests 16 are advanced at a rapid feed rate. However, the contact shoes 161 and 162 do not contact the respective journal portions Wb and We, even after the rapid advance of the contact shoes 161 and 162.

The wheel head 14 is further advanced by an amount DO at an air-cut feed rate F0. After that, a first grinding step is carried out. Namely, the wheel head 14 is advanced by an amount D1 at a feed rate FI for first rough grinding. By the movement in the first grinding step, only the selected journal portions Wb and We are ground by the grinding wheels Gb and Ge. The amount D1 is adjusted so that the advance movement is stopped when the diameters of the selected journal portions Wb and We become substantially equal to the initial diameters of the other journal portions Wa, Wc, Wd and Wf. After that, the wheel head 14 is temporarily stopped for a predetermined time, and then retracted by a small distance in a back-up step. After the above operation, the selected journal portions Wb and We have diameters similar to those of other journal portions Wa, Wc, We and Wf.

Since the selected journal portions Wb and We are ground without using the work rests 16, the selected journal portions Wb and We can be ground accurately without being affected by the initial accuracy, namely, the machining accuracy of the previous machining operation. Since only two journal portions are ground in the above-mentioned first grinding step, the amount of defection of the workpiece W due to the grinding force is relatively small as compared with the case where all of the grinding wheels Ga - Gf contact all the journal portions Wa -Wf. Therefore, the journal portions Wb and We can be ground accurately.

After the back-up step, a second grinding step is carried out. In the second grinding step, the contact shoes 161 and 162 are firstly advanced toward the rotational axis of the workpiece W by a predetermined amount. In the course of this operation, the contact shoes 161 and 162 contact the selected journal portions Wb and We. After the advance movement of the contact shoes 161 and 162, the selected journal portions Wb and We are bent toward the grinding heels Gb and Ge by a predetermined amount. After that, the wheel head 14 is advanced at a feed rate F2 for second rough grinding until a first signal is output from the measuring device 17, and the contact shoes 161 and 162 are advanced again by a predetermined amount. After that, the wheel head 14 is advance at a feed rate F3 for finish grinding until a second signal is output from the measuring device 17, and then retracted to the retracted position after a spark-out grinding of a predetermined period of time. The contact shoes 161 and 162 are also retracted to their respective retracted positions.

Since all the journal portions Wa - Wf are around under the condition that the contacts shoes 161 and 162 contact the journal portions Wb and We which have been previously ground to have accurate cylindrical surfaces, it becomes possible to prevent the journal portions Wb and We from irregularly changing their position with respect to the rotational axis of the main spindle 111. Therefore, all the journal portions Wa - Wf can be accurately ground to a desired final diameter.

Although, the grinding machine of the above embodiment is provided with a pair of work rests, the present invention can be applied to grinding machines which have a single work rest, or three or more work rests. The number of the work rests may be changed depending on the number of journal portions to be ground.

In the above-described embodiment, the selected journal portions are ground in the first grinding step to have a dimension substantially equal to the initial dimension of the rest of the journal portions. However, the grinding cycle may be modified such that the advance movement of the wheel head is stopped and the advance movement of the contact shoes is started when the diameter of the selected journal portions reaches a predetermined diameter larger than the initial diameter of the rest of the journal portions.

Further, the grinding cycle may be modified to start the advance movement of the contact shoes without stopping the advance movement of the wheel head. In this case, the first rough grinding and second rough grinding are carried out continuously.

Obviously, numerous modifications and variations of the present invention are possible in light of the above teachings. It is therefore to be understood that within the scope of the appended claims, the present invention may be practiced otherwise than as specifically described herein.

What is claimed is:

1. A method of grinding plural cylindrical portions of a workpiece with plural grinding wheels, wherein said method comprises the steps of:

providing a workpiece having plural cylindrical portions to be ground, the diameter of at least one selected cylindrical portion being larger than those of the rest of the cylindrical portions, said at least one selected cylindrical portion being fewer in number than all of said plural cylindrical portions;

providing a work rest having a movable contact shoe which is engagable with an outer surface of said at least one selected cylindrical portion;

positioning said contact shoe at a position away from the outer surface of said at least one selected cylindrical portion;

advancing said grinding wheels in a first grinding step to partially grind said at least one selected cylindrical portion and fewer than all of said plural cylindrical portions;

advancing said contact shoe for supporting the outer surface of said at least one selected cylindrical portion which has been partially ground; and advancing said grinding wheels to grind all of said cylindrical portions to a predetermined dimension.

2. A method of grinding a workpiece according to claim 1, wherein said method further comprises a step for retracting said grinding wheels by a predetermined distance after said first grinding step.

3. A method of grinding a workpiece according to claim 2, wherein said grinding wheels are advanced in said first grinding step until a predetermined amount of infeed has been carried out, and are advanced in said second grinding step until the dimension of one of said cylindrical portions measured by a measuring device has reached a predetermined dimension.

4. A method of grinding a workpiece according to claim 3, wherein said grinding wheels and said contact shoe of said work rest are advanced alternately in said second grinding step.

* * * * *